US005779563A

United States Patent [19]

Yamagishi et al.

[11] Patent Number: 5,779,563

[45] Date of Patent: Jul. 14, 1998

[54] MULTI-PIECE SOLID GOLF BALL

[75] Inventors: Hisashi Yamagishi; Yasushi Ichikawa; Atsushi Nakamura, all of Chichibu, Japan

[73] Assignee: Bridgestone Sports Co., Ltd., Tokyo, Japan

[21] Appl. No.: 796,454

[22] Filed: Feb. 10, 1997

Related U.S. Application Data

[60] Provisional application No. 60/017,271 May 13, 1996.

[30] Foreign Application Priority Data

Feb. 9, 1996 [JP] Japan ..... 8-048137

[51] Int. Cl.[6] ..... A63B 37/06; A63B 37/12

[52] U.S. Cl. ..... 473/371; 473/373; 473/384

[58] Field of Search ..... 473/374, 373, 473/384, 372, 377, 378

[56] References Cited

U.S. PATENT DOCUMENTS 4,714,253 12/1987 Nakahara et al. ..... 473/374 X
5,002,281 3/1991 Nakahara et al. ..... 473/374 X
5,497,996 3/1996 Cadorniga ..... 473/378 X
5,553,852 9/1996 Higuchi et al. ..... 473/378 X
5,601,503 2/1997 Yamagishi et al. ..... 473/384

*Primary Examiner*—George J. Marlo
*Attorney, Agent, or Firm*—Sughrue, Mion, Zinn, Macpeak & Seas, PLLC

[57] ABSTRACT

A multi-piece solid golf ball comprises a solid core and a cover of at least two layers enclosing the core and having a number of dimples in cover outer layer surface. The solid core is formed of a rubber base and has a specific gravity of at least 1.00. The cover is formed of a thermoplastic resin and the cover outer layer has a greater specific gravity than the core or a cover inner layer. The golf ball has an inertia moment (M) within the range given by the following expression: $M_{DL} \leqq M \leqq M_{UL}$ wherein $M_{UL}=0.08D+84.8$ and $M_{DL}=0.08D+77.8$ wherein D is a Shore D hardness of the cover, the dimples occupy at least 60% of the ball surface, and $V_0$ is in the range of 0.4 to 0.65. The ball is improved in flight distance, controllability, roll and straight travel upon putting.

5 Claims, 2 Drawing Sheets

MULTI-PIECE SOLID GOLF BALL

CROSS REFERENCE TO RELATED APPLICATIONS

This application is an application filed under 35 U.S.C. § 111(a) claiming benefit pursuant to 35 U.S.C. § 119(e) (i) of the filing date of the Provisional application 60/017,271 filed May 13, 1996, pursuant to 35 U.S.C. § 111(b).

BACKGROUND OF THE INVENTION

1. Field of the Invention

This invention relates to a multi-piece solid golf ball which is improved in flying distance, controllability, roll and straight travel upon putting as well as restitution and durability.

2. Prior Art

Many covers of golf balls used in the art are composed mainly of ionomer resins and have a specific gravity of about 0.96. In order that solid golf balls be usable in competitions, they must meet the requirements prescribed in the Rules of Golf (R&A) and be manufactured to a weight of not greater than 45.93 grams and a diameter of not less than 42.67 mm. Therefore, golf balls obtained using cover stocks composed mainly of ionomer resins will have an inertia moment within a certain range.

The inertia moment of a golf ball largely affects the flight trajectory, flight distance, and control of the ball. In general, an increased inertia moment permits the golf ball to follow an elongated trajectory because the spin attenuation rate of the golf ball in flight is reduced so that the spin is maintained when the ball descends past the maximum altitude. Also when hit on the green with a putter, the ball will go straight and roll well. For these reasons, several proposals have been made on golf balls to impart a greater inertia moment thereto.

For example, Japanese Pat. application Kokai (JP-A) No. 277,312/1994 proposes a solid golf ball which is made from an ionomer resin base having titanium white and barium sulfate blended therein so that the ball may have a greater inertia moment.

This proposal, however, suffers from the problems that the golf ball can be scraped and chafed upon iron shots because the cover formed thereon contains much fillers such as titanium white and barium sulfate and that the ball cannot travel a satisfactory distance because the large filler content deteriorates the restitution of the cover.

SUMMARY OF THE INVENTION

An object of the invention is to provide a multi-piece solid golf ball having a cover which has an optimum inertia moment for a certain hardness of a cover outermost layer and an optimum dimple pattern so that the ball is improved in flying distance, controllability, straight travel and roll upon putting as well as durability.

Making extensive investigations to attain the above object, the inventors have found that a multi-piece solid golf ball having a cover of at least two layers is improved in flying distance, controllability, roll and straight travel upon putting on the green as well as restitution and cover durability against iron shots when the core is formed to a specific gravity of 1.00 or higher using a rubber base material, the cover outer layer is formed to a greater specific gravity than the core, the ball has an inertia moment (M) within the range given by the following expression:

$$M_{DL} \leqq M \leqq M_{UL}$$

wherein $M_{UL}=0.08D+84.8$ and $M_{DL}=0.08D+77.8$ wherein D is a Shore D hardness of a thermoplastic resin of which the cover outer layer is made, that is, an inertia moment is selected in accordance with a cover outer layer hardness, dimples occupy at least 60% of the ball surface, and $V_0$ which is the ratio of the volume of the dimple space below a plane circumscribed by the dimple edge to the volume of a cylinder whose bottom is the plane and whose height is the maximum depth of the dimple from the bottom is in the range of 0.4 to 0.65, and preferably, the core hardness, an index (Dst) of overall dimple surface area given by the following expression:

$$Dst = \frac{n \sum_{k=1}^{n} |(Dmk^2 + Dpk^2) x V_0 k x Nk|}{4R^2}$$

wherein R is a ball radius, Nk is the number of dimples k, and $V_0$ is as defined above, and the cover outer layer hardness are optimized, and advantageously in this embodiment, the cover outer layer is formed of a thermoplastic polyurethane elastomer.

Accordingly, the present invention provides a multi-piece solid golf ball comprising a solid core and a cover of at least two layers enclosing the core and having a number of dimples in the surface of a cover outer layer, wherein said solid core is formed of a rubber base and has a specific gravity of at least 1.00, said cover is formed of a thermoplastic resin and the cover outer layer has a greater specific gravity than the core and a cover inner layer, the golf ball has an inertia moment (M) within the range given by the following expression:

$$M_{DL} \leqq M \leqq M_{UL}$$

wherein $M_{UL}=0.08D+84.8$ and $M_{DL}=0.08D+77.8$ wherein D is a Shore D hardness of the cover, the dimples occupy at least 60% of the ball surface, and $V_0$ which is the ratio of the volume of the dimple space below a plane circumscribed by the dimple edge to the volume of a cylinder whose bottom is the plane and whose height is the maximum depth of the dimple from the bottom is in the range of 0.4 to 0.65.

DETAILED DESCRIPTION OF THE INVENTION

Figure 1:
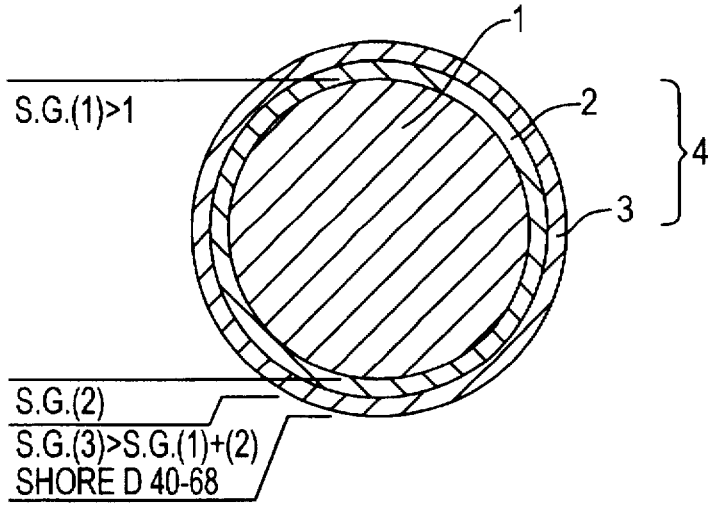
FIG. 1 is a cross-sectional view of a golf ball according to one embodiment of the invention.

The present invention is described below in further detail. As shown in FIG. 1, the multi-piece solid golf ball of the invention comprises a solid core 1 formed of a rubber base and a cover 4 on the core consisting of two layers, an inner layer 2 and an outer 3. The cover 4 consists of two or more layers.

The solid core 1 should have a specific gravity of at least 1.00, preferably 1.02 to 1.18, more preferably 1.06 to 1.15.

The solid core 1 used herein may be made of well-known materials and formed by conventional techniques while properly adjusting vulcanizing conditions and formulation. The core formulation used herein may contain a base rubber, crosslinking agent, co-crosslinking agent, and inert filler. The base rubber which can be used herein is natural rubber and/or synthetic rubber used in conventional solid golf balls. It is preferred in the practice of the invention to use 1,4-polybutadiene having at least 40% of cis-structure. The polybutadiene may be blended with natural rubber, polyisoprene rubber, styrene-butadiene rubber or the like, if desired.

The crosslinking agent which can be used herein is an organic peroxide such as dicumyl peroxide and di-t-butyl peroxide, especially dicumyl peroxide. The amount of the crosslinking agent blended is preferably 0.5 to 1.8 parts by weight, especially 0.8 to 1.5 parts by weight per 100 parts by weight of the base rubber.

The co-crosslinking agent is not critical. Examples are metal salts of unsaturated fatty acids, inter alia, zinc and magnesium salts of unsaturated fatty acids having 3 to 8 carbon atoms (e.g., acrylic acid and methacrylic acid), with zinc acrylate being especially preferred. The amount of the co-crosslinking agent blended is 10 to 40 parts by weight, preferably 15 to 35 parts by weight per 100 parts by weight of the base rubber.

Examples of the inert filler include zinc oxide, barium sulfate, silica, calcium carbonate, and zinc carbonate, with zinc oxide being often used. The amount of the filler blended is not particularly limited because the amount largely varies with the specific gravity of the core and cover, the weight prescription of the ball, and other factors. Usually, the amount of filler is preferably 5 to 25 parts by weight, more preferably 7 to 20 parts by weight per 100 parts by weight of the base rubber.

A core-forming composition is prepared by kneading the above-mentioned components in a conventional mixer such as a Banbury mixer and roll mill, and it is compression or injection molded in a core mold. The molding is then cured by heating at a sufficient temperature for the crosslinking agent and co-crosslinking agent to function (for example, a temperature of about 130° to 170° C. for a combination of dicumyl peroxide as the crosslinking agent and zinc acrylate as the co-crosslinking agent), obtaining a core.

By a proper choice of the type and amount of compounding materials, especially crosslinking agent and co-crosslinking agent and vulcanizing conditions, a core having a desired hardness (as expressed by a distortion under a load of 100 kg) can be obtained. Herein, the core is preferably formed to yield a distortion under a load of 100 kg of 2.0 to 5.0 mm, more preferably 3.0 to 4.8 mm. With a distortion falling within this range, sufficient restitution, pleasant hitting feel, and improved scraping resistance are achievable.

It is noted that the solid core 1 preferably has a diameter of 25 to 41 mm, especially 30 to 40 mm and a weight of 20 to 40 grams, especially 23 to 39.5 grams.

Next, the cover 4 enclosing the above-mentioned solid core 1 consists of two or more layers and is preferably of a two-layer structure of cover inner and outer layers 2 and 3.

The cover outer layer 3 is formed to a greater specific gravity than the core 1 and the cover inner layer 2, thereby achieving a high inertia moment and producing a golf ball having excellent flight stability and go-straight stability upon putting. In contrast, the object of the invention is not achievable if the cover outer layer's specific gravity is lower than the specific gravity of the core and cover inner layer. The cover outer layer's specific gravity is properly selected in accordance with the specific gravity of the core and cover inner layer although it is preferred that the cover outer layer is formed to a specific gravity of at least 1.10, especially 1.10 to 1.25 and the difference of specific gravity between the cover outer layer and the core is 0.01 to 0.15.

Also the cover outer layer hardness is not critical although the cover outer layer is preferably formed to a Shore D hardness of 40 to 68, more preferably 43 to 65. A Shore D hardness of less than 40 would lead to low restitution whereas a Shore D hardness of more than 68 would blunt the hitting feel.

The cover outer layer stock used herein is not critical insofar as the cover outer layer is formed to a greater specific gravity than the solid core and cover inner layer. The cover outer layer may be formed of conventional cover stocks, preferably thermoplastic resins. The thermoplastic resins used herein include thermoplastic polyurethane elastomers, ionomer resins, polyester elastomers, polyamide elastomers, propylene-butadiene copolymers, 1,2-polybutadiene, and styrene-butadiene copolymers. These resins may be used alone or in admixture of two or more. It is preferred in the practice of the invention to use thermoplastic polyurethane elastomers as a base, for example, PANDEX T-7890 and PANDEX T-1198 (trade name, by Dai-Nihon Ink Chemical Industry K.K.). To satisfy the cover's specific gravity defined above, various fillers such as barium sulfate, titanium oxide and magnesium stearate may be blended in the thermoplastic resin.

Desirably the cover inner layer has a specific gravity of 0.9 to 1.2 and the cover outer layer has a specific gravity of at least 1.10 as mentioned above. It is also preferred that the cover outer layer has a highest specific gravity among the core, cover inner and outer layers.

The gage of the cover inner and outer layers is arbitrary although it is preferred that the cover inner layer has a gage of 0.3 to 2.5 mm and the cover outer layer has a gage of 0.3 to 2.5 mm.

Understandably, the golf ball may be manufactured by conventional methods. That is, the golf ball can be obtained by preforming a pair of half cups of single or multi-layers from a cover stock, and encasing the solid core in the cover by compression molding or the like to thereby form a cover of two or more layers. Alternatively, the cover may be formed by injection molding.

Also the golf ball of the invention has an inertia moment (M) in proportion to the cover outer layer hardness (Shore D hardness) within the range given by the following expression:

$$M_{DL} \leq M \leq M_{UL}$$

wherein $M_{UL}=0.08D+84.8$ and $M_{DL}=0.08D+77.8$ wherein D is a Shore D hardness of the cover outer layer.

More specifically, we have found that the inertia moment should fall in an optimum range correlated to the cover hardness. The inertia moment should be greater when the cover is hard, but need not be greater as required for the hard cover when the cover is soft. This is because a ball with a soft cover provides a greater frictional force upon impact and receives more spin whereas a ball with a hard cover provides a less frictional force and receives less spin. A hard cover ball launched at a low spin rate will attenuate its spin fast and stall on falling if the inertia moment is low. Inversely, a soft cover ball launched at a high spin rate will experience less spin attenuation if the inertia moment is too high, so that the ball will rather climb up during flight due to more spin than necessity. In either case, the ball tends to travel a shorter distance.

Consequently, the inertia moment of a ball should fall within the above-defined range from the standpoint of imparting excellent characteristics to a ball. An inertia moment below the lower limit of the above-defined range would lead to a stalling trajectory whereas an inertia moment above the upper limit of the above-defined range would lead to a rather climb-up trajectory. In either case, the carry is reduced.

The inertia moment (M) within the above-defined range is determined by the following equation.

$$M = \frac{\pi}{580000}\ [(r_1 - r_2)xD_1^5 + (r_2 - r_3)xD_2^5 + r_3D_3^5]$$

$r_1$, $D_1$: core specific gravity, diameter $r_2$, $D_2$: intermediate layer specific gravity, diameter $r_3$, $D_3$: cover specific gravity, ball diameter Like conventional golf balls, the solid golf ball of the invention is formed with a multiplicity of dimples in the surface. The golf ball of the invention is formed with dimples such that, provided that the golf ball is a sphere defining a phantom spherical surface, the proportion of the surface area of the phantom spherical surface delimited by the edge of respective dimples relative to the overall surface area of the phantom spherical surface, that is the percent occupation of the ball surface by the dimples is at least 60%, preferably 60 to 80%. With a lower dimple occupation, the inertia moment in flight has less of the above-mentioned effect. The number of dimples is preferably 350 to 500, more preferably 360 to 460. The arrangement of dimples may be as in conventional golf balls. There may be two or more types of dimples which are different in diameter and/or depth. It is preferred that the dimples have a diameter of 2.5 to 4.3 mm and a depth of 0.14 to 0.25 mm.

Moreover, the dimples are formed such that $V_0$ is 0.40 to 0.65, especially 0.43 to 0.60 wherein $V_0$ is the ratio of the volume of the dimple space below a plane circumscribed by the dimple edge to the volume of a cylinder whose bottom is the plane and whose height is the maximum depth of the dimple from the bottom. If $V_0$ exceeds 0.65, there is a likelihood that the ball climb up and stall, covering a shorter distance. If $V_0$ is below 0.40, the trajectory would tend to descend.

Figure 2:
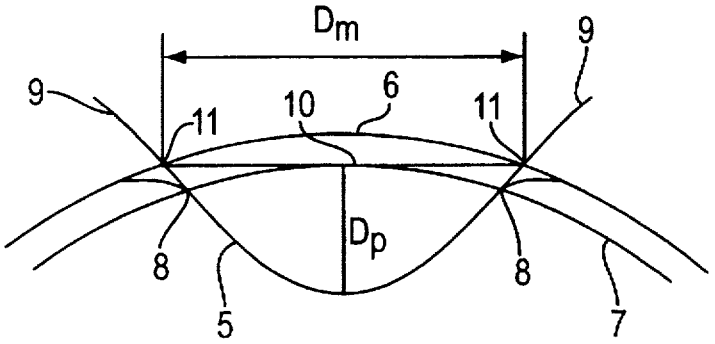
FIG. 2 is a schematic view (cross-sectional view) of a dimple illustrating how to calculate $V_0$.
Figure 3:
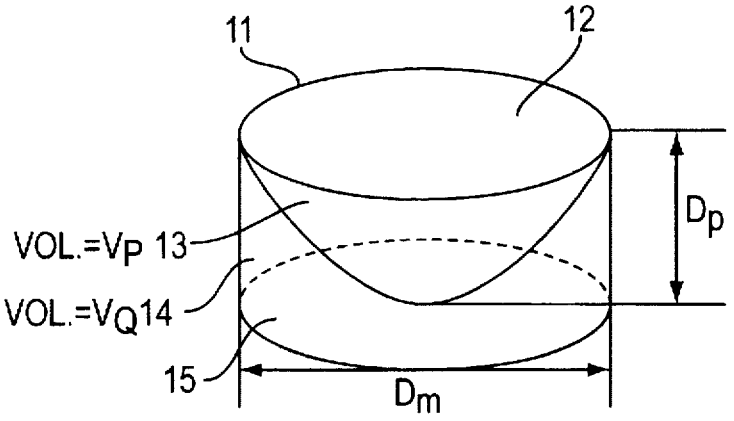
FIG. 3 is a perspective view of the same dimple.
Figure 4:
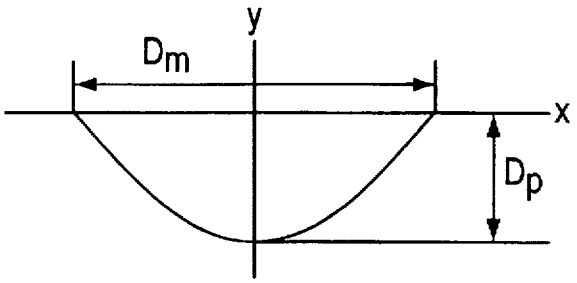
FIG. 4 is a cross-sectional view of the same dimple.

Now the shape of dimples is described in further detail. In the event that the planar shape of a dimple is circular, as shown in FIG. 2, a phantom sphere 2 having the ball diameter and another phantom sphere 3 having a diameter smaller by 0.16 mm than the ball diameter are drawn in conjunction with a dimple 1. The circumference of the other sphere 3 intersects with the dimple 1 at a point 4. A tangent 5 at intersection 4 intersects with the phantom sphere 2 at a point 6 while a series of intersections 6 define a dimple edge 7. The dimple edge 7 is so defined for the reason that otherwise, the exact position of the dimple edge cannot be determined because the actual edge of the dimple 1 is rounded. The dimple edge 7 circumscribes a plane 8 (having a diameter Dm). Then as shown in FIGS. 3 and 4, the dimple space 9 located below the plane 8 has a volume Vp. A cylinder 10 whose bottom is the plane 8 and whose height is the maximum depth Dp of the dimple from the bottom or circular plane 8 has a volume Vq. The ratio $V_0$ of the dimple space volume Vp to the cylinder volume Vq is calculated.

$$Vp = \int_0^{\frac{Dm}{2}} 2\pi xy\,dx$$

$$Vq = \frac{\pi Dm^2 Dp}{4}$$

$$V_0 = \frac{Vp}{Vq}$$

In the event that the planar shape of a dimple is not circular, the maximum diameter or length of a dimple is determined, the plane projected shape of the dimple is assumed to be a circle having a diameter equal to this maximum diameter or length, and $V_0$ is calculated as above based on this assumption.

Furthermore, the golf ball of the invention wherein the number of types of dimples formed in the ball surface is n and the respective types of dimples have a diameter Dmk, a maximum depth Dpk, and a number Nk wherein k=1, 2, 3, . . . . n prefers that an index Dst of overall dimple surface area given by the following equation is at least 4.0, more preferably 4.0 to 7.0.

$$Dst = \frac{n \sum_{k=1}^{n} [(Dmk^2 + Dpk^2)xV_0kxNk]}{4R^2}$$

Note that R is a ball radius, $V_0$ is as defined above, and Nk is the number of dimples k. The index Dst of overall dimple surface area is useful in optimizing various dimple parameters so as to allow the golf ball of the invention having the above-mentioned solid core and cover to travel a further distance. When the index Dst of overall dimple surface area is equal to or greater than 4.0, the aerodynamics (flying distance and flight-in-wind) of the golf ball are further enhanced.

The multi-piece solid golf ball of the invention is improved in flying distance, controllability, roll and straight travel upon putting and is less susceptible to scraping upon iron shots.

EXAMPLE

Examples of the present invention are given below together with Comparative Examples by way of illustration and not by way of limitation.

Examples and Comparative Examples

By kneading a core stock as shown in Table 1 and vulcanizing it in a mold at 160° C. for about 18 minutes, there were prepared solid cores having a weight, diameter, specific gravity and distortion under a load of 100 kg as shown in Table 4.

Golf balls were then obtained by separately kneading an outer cover stock as shown in Table 2 and an inner cover stock as shown in Table 4 and forming them into half cups, successively placing the half cups around the core, and effecting compression molding while forming dimples on the outer layer surface in a pattern as shown in Table 3. The parameters and performance properties of the resulting golf balls were examined, with the results shown in Table 4.

The properties of the golf balls reported in Table 4 were evaluated by the following tests.

Inertia Moment

The diameter of the respective members was an average of diameters measured at arbitrary 5 points. As to weight, the ball was disintegrated into the respective members, which were measured for weight. The net weight and volume were calculated therefrom and the specific gravity of the respective members was calculated therefrom. The inertia moment was determined by substituting these values in the following equation.

$$M = \frac{\pi}{580000} \left|(r_1 - r_2)\times D_1^5 + (r_2 - r_3)\times D_2^5 + r_3 D_3^5\right|$$

$r_1$, $D_1$: core specific gravity, diameter $r_2$, $D_2$: intermediate layer specific gravity, diameter $r_3$, $D_3$: cover specific gravity, ball diameter

Flying Distance

Using a hitting machine manufactured by True Temper Co., the ball was actually hit at a head speed (HS) of 45 m/sec. with a driver to measure a carry and a total distance.

Scrape Resistance

Using a swing robot, the ball was hit at arbitrary two positions, once at each position, at a head speed of 38 m/sec. with a sand wedge (SW). The two hit zones were observed to evaluate according to the following criteria.

O: good Δ: ordinary X: poor

Continuous Durability

Using a flywheel hitting machine, the ball was repeatedly hit at a head speed of 38 m/sec. In terms of the number of hits counted until the ball was broken, evaluation was made according to the following criteria.

O: good Δ: ordinary X: poor

Feeling

The ball was actually hit by three professional golfers with a head speed of 45 to 50 m/sec. Evaluation was made according to the following criteria.

O: soft Δ: ordinary X: hard

TABLE 1

| Core formulation (pbw) | E1 | E2 | E3 | E4 | CE1 |
|---|---|---|---|---|---|
| Cis-1,4-polybutadiene | 100 | 100 | 100 | 100 | 90 |
| Polyisoprene | — | — | — | — | 10 |
| Zinc acrylate | 32.5 | 32.5 | 29.5 | 25.0 | 27.0 |

TABLE 1-continued

| Core formulation (pbw) | E1 | E2 | E3 | E4 | CE1 |
|---|---|---|---|---|---|
| Zinc oxide | 9.2 | 10.5 | 8.5 | 16.2 | 14.6 |
| Dicumyl peroxide | 1.2 | 1.2 | 1.2 | 1.2 | 1.2 |
| Zinc salt of pentachlorothiophenol | 0.2 | 0.2 | 0.2 | 0.2 | — |

TABLE 2

| | Outer cover type | | |
|---|---|---|---|
| Formulation (pbw) | A | B | C |
| PANDEX T-7890*1 | 100 | | |
| PANDEX T-1198*2 | | 100 | |
| HIMILAN 1706*3 | | | 50 |
| SURLYN 8120*4 | | | 50 |
| $BaSO_4$ (s.g. 4.47) | | | 20 |
| $TiO_2$ (s.g. 4.3) | 5.3 | 5.3 | 5.3 |
| Magnesium stearate | 0.5 | 0.5 | 0.5 |
| Specific gravity | 1.175 | 1.21 | 1.13 |

*1Dai-Nihon Ink Chemical Industry K.K., adipate polyol, thermoplastic polyurethane

*2Dai-Nihon Ink Chemical Industry K.K., adipate polyol, thermoplastic polyurethane

*3Mitsui-duPont K.K., Zn ionomer

*4E. I. duPont, Na soft ionomer

TABLE 3

| Dimple type | Diameter (mm) | Depth (mm) | $V_0$ | Number | Surface occupation (%) | Dst |
|---|---|---|---|---|---|---|
| I | 4.100 | 0.210 | 0.500 | 54 | 68.7 | 4.137 |
| | 3.850 | 0.210 | 0.500 | 174 | | |
| | 3.400 | 0.210 | 0.500 | 132 | | |
| II | 4.150 | 0.210 | 0.480 | 54 | 70.3 | 4.061 |
| | 3.850 | 0.210 | 0.480 | 174 | | |
| | 3.500 | 0.210 | 0.480 | 132 | | |
| III | 3.650 | 0.195 | 0.390 | 150 | 62.7 | 1.961 |
| | 3.500 | 0.195 | 0.390 | 210 | | |

TABLE 4

| | | E1 | E2 | E3 | E4 | CE1 | CE2 | CE3 |
|---|---|---|---|---|---|---|---|---|
| Core | Weight | 25.44 | 29.02 | 26.19 | 27.10 | 33.53 | 25.44 | 14.69 |
| | Diameter | 35.50 | 37.00 | 36.00 | 36.00 | 38.70 | 35.50 | 27.70 |
| | Distortion under 100 kg load | 2.20 | 2.20 | 2.60 | 3.30 | 2.50 | 2.20 | 4.00 |
| | Volume | 23.43 | 26.52 | 24.43 | 24.43 | 30.35 | 23.43 | 11.13 |
| | Specific gravity | 1.086 | 1.094 | 1.072 | 1.109 | 1.105 | 1.086 | 1.320 |
| Inner cover | Type *5 | a | a | a | b | — | a | a |
| | Weight (g) | 33.20 | 35.90 | 32.84 | 32.84 | — | 33.20 | 34.52 |
| | Diameter (mm) | 38.75 | 39.70 | 38.75 | 38.75 | — | 38.75 | 38.30 |
| | Volume | 7.04 | 6.24 | 6.04 | 6.04 | — | 7.04 | 18.29 |
| | Specific gravity (calcd.) | 1.102 | 1.102 | 1.102 | 0.950 | — | 1.102 | 1.102 |
| | Net weight | 7.76 | 6.88 | 6.65 | 5.74 | — | 7.76 | 20.15 |
| | Gage | 1.63 | 1.35 | 1.38 | 1.38 | — | 1.63 | 5.30 |

TABLE 4-continued

| | | | | | | | | |
|---|---|---|---|---|---|---|---|---|
| Outer cover | Type | A | A | B | B | C | A | D |
| | Volume | 10.30 | 8.00 | 10.30 | 10.30 | 10.42 | 10.30 | 11.35 |
| | Net weight (g) | 12.10 | 9.40 | 12.46 | 12.46 | 11.77 | 12.10 | 10.78 |
| | Specific gravity | 1.175 | 1.175 | 1.210 | 1.210 | 1.130 | 1.175 | 0.950 |
| | Gage (mm) | 1.98 | 1.50 | 1.98 | 1.98 | 2.00 | 1.98 | 2.10 |
| | Shore D hardness | 45 | 45 | 53 | 53 | 55 | 45 | 65 |
| Ball | Weight (g) | 45.30 | 45.30 | 45.30 | 45.30 | 45.30 | 45.30 | 45.30 |
| | Diameter (mm) | 42.70 | 42.70 | 42.70 | 42.70 | 42.70 | 42.70 | 42.70 |
| Inertia moment | | 85.2 | 85.0 | 85.8 | 84.8 | 84.5 | 85.2 | 80.6 |
| | $M_{UL}$ | 88.4 | 88.4 | 89.0 | 89.0 | 89.2 | 88.4 | 90.0 |
| | $M_{DL}$ | 81.4 | 81.4 | 82.0 | 82.0 | 82.2 | 81.4 | 83.0 |
| Dimple type | | I | II | I | II | I | III | I |
| Flying distance @HS40 | Carry (m) | 184.5 | 185.2 | 185.7 | 185.5 | 180.3 | 177.0 | 183.0 |
| | Total (m) | 198.6 | 199.0 | 200.0 | 200.5 | 195.7 | 191.5 | 197.5 |
| Scrape resistance | | ○ | ○ | ○ | ○ | X | ○ | ○ |
| Continuous durability | | ○ | ○ | ○ | ○ | Δ | ○ | Δ |
| Feeling | | ○ | ○ | ○ | ○ | Δ | ○ | ○ |

| *5 Inner cover type | a | b |
|---|---|---|
| HYTREL 4047 | 100 | |
| HIMILAN 1706 | | 50 |
| HIMILAN 1605 | | 50 |

We claim:

1. A multi-piece solid golf ball comprising a solid core and a cover of at least two layers enclosing the core and having a number of dimples in the surface of a cover outer layer, wherein said solid core is formed of a rubber base and has a specific gravity of at least 1.00, said cover is formed of a thermoplastic resin and the cover outer layer has a greater specific gravity than the core and a cover inner layer, the golf ball has an inertia moment (M) within the range given by the following expression:

$$M_{DL} \leqq M \leqq M_{UL}$$

wherein $M_{UL}$=0.08D+84.8 and $M_{DL}$=0.08D+77.8 wherein D is a Shore D hardness of the cover, the dimples occupy at least 60% of the ball surface, and $V_O$ which is the ratio of the volume of the dimple space below a plane circumscribed by the dimple edge to the volume of a cylinder whose bottom is the plane and whose height is the maximum depth of the dimple from the bottom is in the range of 0.4 to 0.65.

2. The multi-piece solid golf ball of claim 1 wherein said solid core experiences a distortion of 2.0 to 5.0 mm under a load of 100 kg.

3. The multi-piece solid golf ball of claim 1 wherein n types of dimples are formed in the cover, the respective types of dimples have a diameter Dmk, a maximum depth of the dimples is Dpk, and a number of the dimples is Nk wherein k=1, 2, 3, . . . . , n, and an index (Dst) of overall dimple surface area given by the following expression:

$$Dst = \frac{n \sum_{k-1}^{n} |(Dmk^2 + Dpk^2) x V_0 k x Nk|}{4R^2}$$

wherein R is a ball radius, Nk is the number of dimples k, and $V_O$. is as defined above is at least 4.0.

4. The multi-piece solid golf ball of claim 1 wherein said cover outer layer has a Shore D hardness of 40 to 68.

5. The multi-piece solid golf ball of claim 1 wherein said cover outer layer is formed of a polyurethane elastomer.

* * * * *